US011306736B2

(12) United States Patent
Umematsu

(10) Patent No.: US 11,306,736 B2
(45) Date of Patent: Apr. 19, 2022

(54) BLOWER

(71) Applicant: SHINANO KENSHI KABUSHIKI KAISHA, Nagano (JP)

(72) Inventor: Akishige Umematsu, Nagano (JP)

(73) Assignee: SHINANO KENSHI KABUSHIKI KAISHA, Nagano (JP)

( * ) Notice: Subject to any disclaimer, the term of this patent is extended or adjusted under 35 U.S.C. 154(b) by 0 days.

(21) Appl. No.: 17/134,628

(22) Filed: Dec. 28, 2020

(65) Prior Publication Data

US 2021/0254632 A1 Aug. 19, 2021

(30) Foreign Application Priority Data

Feb. 18, 2020 (JP) ..... JP2020-024859

(51) Int. Cl.

| | |
|---|---|
| ***F04D 29/66*** | (2006.01) |
| ***F04D 29/52*** | (2006.01) |
| ***F04D 19/00*** | (2006.01) |
| ***F04D 29/08*** | (2006.01) |
| ***F04D 25/08*** | (2006.01) |

(52) U.S. Cl.

CPC ..... *F04D 29/522* (2013.01); *F04D 19/002* (2013.01); *F04D 25/08* (2013.01); *F04D 29/083* (2013.01); *F04D 29/668* (2013.01)

(58) Field of Classification Search

CPC ..... F04D 29/522; F04D 19/002; F04D 25/08; F04D 29/083; F04D 29/668; F04D 29/626; F04D 25/0606; F04D 29/403

See application file for complete search history.

(56) References Cited

U.S. PATENT DOCUMENTS

| | | | | |
|---|---|---|---|---|
| 5,679,992 | A * | 10/1997 | Miyamoto | F04D 29/668 310/90.5 |
| 2008/0014104 | A1* | 1/2008 | Huang | F04D 29/668 417/423.7 |
| 2012/0138058 | A1* | 6/2012 | Fu | A61M 16/0633 128/204.23 |
| 2014/0341759 | A1* | 11/2014 | Calico | H02K 1/185 417/349 |
| 2017/0110932 | A1* | 4/2017 | Berkouk | H02K 5/24 |
| 2017/0146033 | A1* | 5/2017 | Pacilli | F04D 29/043 |
| 2017/0204868 | A1* | 7/2017 | Oshita | F02B 39/10 |
| 2017/0227020 | A1* | 8/2017 | Arima | F04D 29/665 |

(Continued)

FOREIGN PATENT DOCUMENTS

| | | |
|---|---|---|
| JP | 2002-21797 | 1/2002 |
| JP | 2003-106263 | 4/2003 |
| JP | 2018-126034 | 8/2018 |

OTHER PUBLICATIONS

Notification of Refusal dated Jul. 13, 2021 in Japanese Application No. 2020-024859.

*Primary Examiner* — Aaron R Eastman

(74) *Attorney, Agent, or Firm* — Stephen J. Weyer, Esq.; Stites & Harbison, PLLC

(57) ABSTRACT

A stator core is assembled to an inner wall surface of a first motor case through a sealing member covering an outer peripheral surface and both end edge portions in an axial direction of the stator core, which is assembled so that both end edge portions of the sealing member in the axial direction are sandwiched so as be pressed respectively by protruding wall portions provided in a fan case and a motor case so as to face each other.

5 Claims, 1 Drawing Sheet

(56) References Cited

U.S. PATENT DOCUMENTS

| | | | | |
|---|---|---|---|---|
| 2017/0268524 | A1* | 9/2017 | Kanai | F04D 29/056 |
| 2018/0100517 | A1* | 4/2018 | Sawada | F04D 29/58 |
| 2018/0156233 | A1* | 6/2018 | Sawada | F04D 29/44 |
| 2018/0163747 | A1* | 6/2018 | Hayamitsu | H02K 9/14 |
| 2018/0223874 | A1* | 8/2018 | Maruyama | F04D 29/059 |
| 2019/0021562 | A1* | 1/2019 | Shiozawa | A47L 5/24 |
| 2021/0285406 | A1* | 9/2021 | Malvasi | F04D 29/053 |
| 2021/0285691 | A1* | 9/2021 | Webb | F25B 1/10 |

* cited by examiner

BLOWER

CROSS-REFERENCE TO RELATED APPLICATION

This application is based upon and claims the benefit of priority of the prior Japanese Patent Application No. 2020-024859, filed on Feb. 18, 2020, and the entire contents of which are incorporated herein by reference.

TECHNICAL FIELD

The present invention relates to a blower used for, for example, medical equipment, industrial equipment, consumer equipment, and so on.

BACKGROUND ART

In blowers used in the past, size reduction is required on one hand, and high pressure, high flow rate, and high responsivity are required with improvement of required performance on the other hand. Accordingly, the technique is shifting toward size reduction of an impeller so as to be rotated at a higher speed.

The blower is configured so that a fan casing housing an impeller and provided with a blowing path is integrally assembled to a motor casing housing a motor that drives the impeller to rotate.

Outside air is sucked into the fan casing from an axial direction by rotation of the impeller when starting the motor, and the air is discharged from the blowing path provided on an outer side in a radial direction.

A vibration isolation material is provided between the motor casing and an apparatus to which the motor casing is assembled, the outside air sucked into the fan casing from the axial direction by the rotation of the impeller leaks into the motor casing as high-pressure fluid, for example, through a gap around a motor shaft, which makes difficult to obtain a desired static pressure.

Although the motor casing is installed with the vibration isolation material interposed between the motor casing and the apparatus to which the motor casing is attached, sealing of the fluid leaking out from the motor casing is not performed.

In order to increase airtightness of the motor casing, a motor component (for example, a stator core) is adhered separately from the vibration isolation material, and a sealing material such as an O-ring is provided inside the motor so as to be compressed in the radial direction and the axial direction, thereby realizing both vibration isolation properties and airtightness.

For example, there is proposed a blower in which the motor is supported and fixed by the casing at plural places through a first elastic member capable of elastically deformed and a second elastic member capable of elastically deformed is provided, which seals a gap between the casing and the motor to prevent leakage of air from the gap, thereby preventing leakage of air while absorbing vibration of the blower (PTL 1: JP-A-2002-21797).

SUMMARY OF INVENTION

Technical Problem

However, the plural elastic members having different elastic moduli are provided for keeping vibration isolation properties and airtightness of the motor casing as in Patent Literature 1, which increases the number of parts and assembly man-hours; therefore, manufacturing costs are also increased. Additionally, there is a danger that sealing properties are not maintained due to deterioration over time in part of the elastic members having different elastic moduli.

Solution to Problem

In response to the above issue, one or more aspects of the present invention are directed to a blower having high output performance and capable of being mass produced at low cost by arranging parts for maintaining vibration isolation properties and airtightness in a concentrated manner to thereby reduce the number of parts and to reduce assembly man-hours.

In view of the above, the following embodiments are described below.

In a blower according to the present invention, a fan case housing an impeller and provided with a blowing path is integrally assembled to a motor case housing a motor that drives the impeller to rotate, and outside air is sucked into the fan case from an axial direction by rotation of the impeller and discharged from the blowing path provided on an outer side in a radial direction, in which a stator core is assembled to an inner wall surface of the motor case through a sealing member covering an outer peripheral surface and both end edge portions in the axial direction thereof, which is assembled so that both end edge portions in the axial direction of the sealing member are sandwiched so as to be pressed respectively by protruding wall portions provided in the fan case and the motor case so as to face each other.

According to the above structure, the protruding wall portions provided in the fan case and the motor case so as to face each other are assembled so as to sandwich and press the both edge portions of the sealing member in the axial direction; therefore, vibration transmitted from a stator and a rotor to the motor case and the fan case can be absorbed by the sealing member to thereby secure vibration isolation properties, and the sealing member pressed by the pair of protruding wall portions facing each other in the axial direction is deformed in an inner side in the radial direction and an outer side in the radial direction to thereby increase adhesiveness between the stator core and the motor case, as a result, fluid leaking out from the inside of the motor can be sealed and airtightness can be increased.

Furthermore, the sealing member for increasing airtightness and vibration isolation properties is arranged in a concentrated manner at the inner wall surface of the motor case, which reduces the number of parts and reduces assembly man-hours; therefore, mass production at low cost can be realized.

A first protruding wall portion and a second protruding wall portion may be annularly provided to protrude with a prescribed interval on the inner side in the radial direction and the outer side in the radial direction, thereby forming a concave groove between the pair of protruding wall portions, and a case opening end portion of the motor case may be inserted into the concave groove and the first protruding wall portion may be fitted to the motor case so that an outer peripheral surface of the first protruding wall portion overlaps with an inner peripheral surface of the motor case, thereby being positioned in the radial direction.

When the first protruding wall portion is fitted so that the outer peripheral surface of the first protruding wall portion overlaps with the inner peripheral surface of the motor case as described above, positioning in the radial direction is performed; therefore, assemblability is improved. As the case opening end portion of the motor case is inserted into the concave groove and fitted in a labyrinth manner, a gap between the fan case and the motor case in the radial direction can be reduced as much as possible and airtightness is improved.

The second protruding portion may be assembled so as to be pushed onto a flange portion provided to protrude on an outer peripheral surface of the motor case while being positioned in the axial direction.

When the fan case is fitted to the motor case while being positioned in the axial direction as described above, assemblability is improved and a gap in the axial direction can be reduced as much as possible to thereby increase airtightness.

It is preferable that pressing surfaces of the protruding wall portions respectively provided in the fan case and the motor case so as to face each other in the axial direction have an R-surface shape. Accordingly, the sealing material is positively deformed so that a wall thickness of the sealing material in the axial direction swells to an inner side in the radial direction and an outer side in the radial direction when the both end edge portions of the sealing member in the axial direction are respectively pressed by the pair of protruding wall portions, thereby increasing adhesiveness between the sealing member and the outer peripheral wall of the stator core/the inner peripheral surface of the motor case, and increasing airtightness. The adhesiveness between the outer peripheral surface of the stator core and the inner peripheral surface of the motor case is increased through the sealing material and adhesiveness between an end surface of the stator core in the axial direction and the fan case is increased through the sealing material; therefore, generated heat of the stator can be transmitted to the motor case and the fan case to thereby maintain heat dissipation properties.

An annular elastic member such as vibration isolation rubber or elastomer may be suitably used as the sealing material. Accordingly, vibration isolation properties and airtightness can be improved with a small number of parts by using an inexpensive material.

Advantageous Effects of Invention

According to the above structure, it is possible to provide a blower having high output performance and capable of being mass produced at low cost by arranging parts for maintaining vibration isolation properties and airtightness in a concentrated manner to thereby reduce the number of parts and to reduce assembly man-hours.

DESCRIPTION OF EMBODIMENTS

Figure 1A:
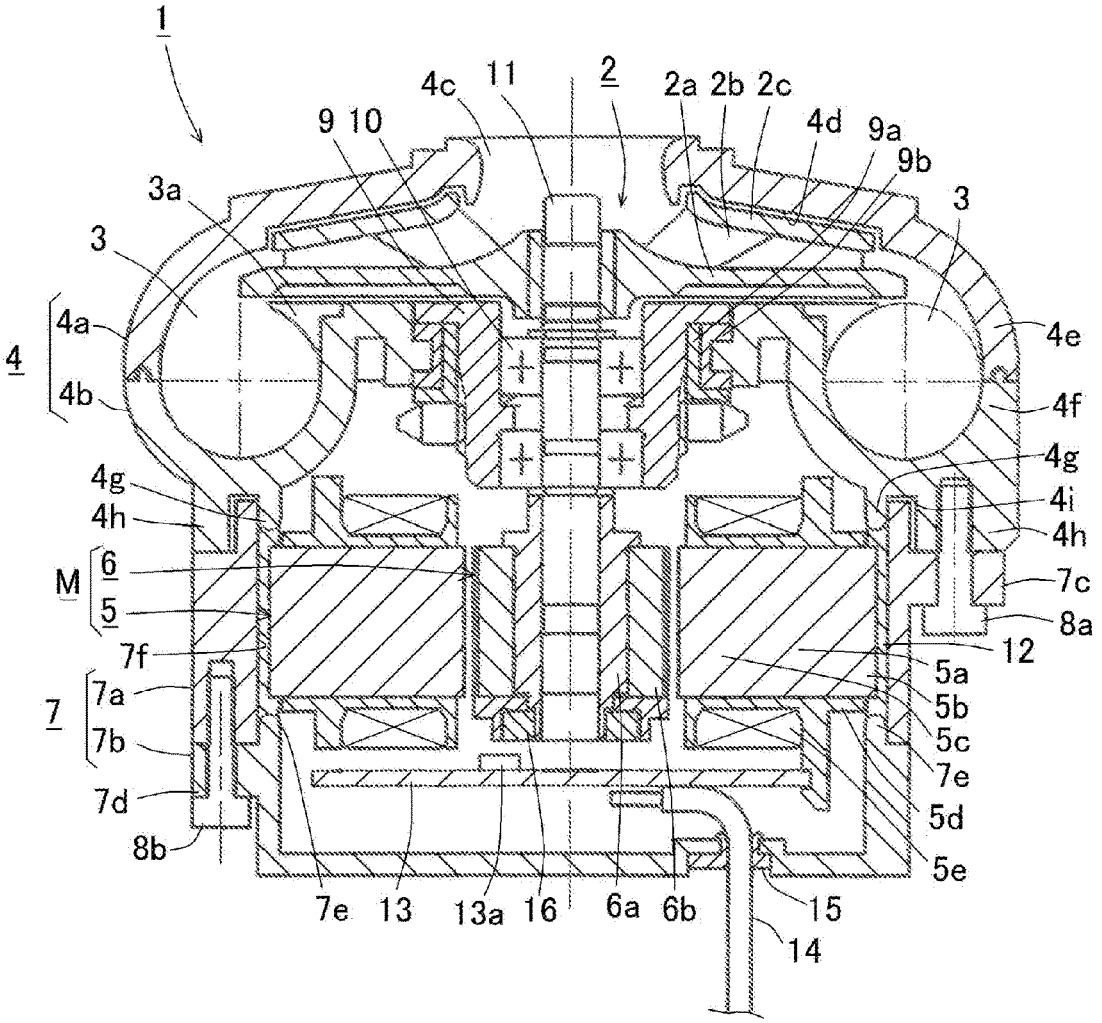
FIGS. 1A and 1B are a cross-sectional view in an axial direction and a partial enlarged cross-sectional view of a blower.

Hereinafter, a blower according to an embodiment of the present invention will be explained with reference to the attached drawing.

First, a schematic structure of the blower will be explained with reference to FIGS. 1A and 1B.

A blower 1 includes the following structure. As shown in FIG. 1A, a fan case 4 housing an impeller 2 and provided with a blowing path 3 is integrally screw-fixed to a motor case 7 housing a stator 5 and a rotor 6 (motor M) by fixing screws 8*a*.

The blower 1 is configured so that outside air is sucked into the fan case 4 from an axial direction by rotation of the impeller 2 when starting the motor M, and the air is discharged from the blowing path 3 provided on an outer side in a radial direction. Hereinafter, structures of respective parts will be explained in detail.

Figure 1B:
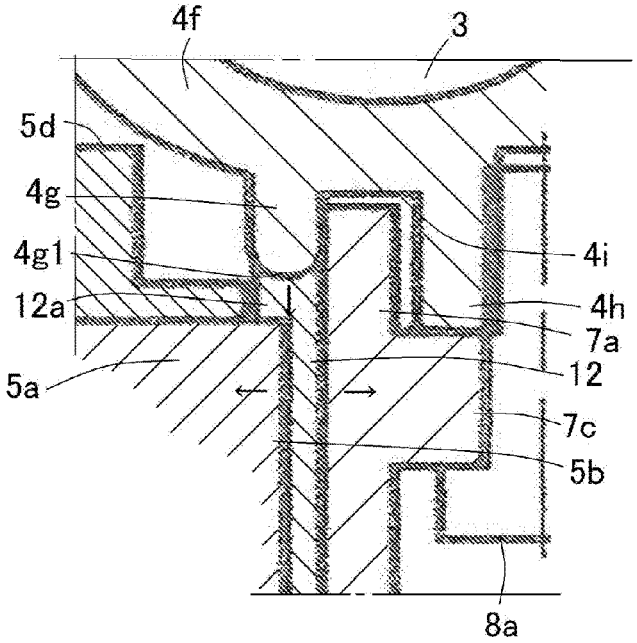

In FIG. 1A, the fan case 4 is configured so that a first fan case 4*a* and a second fan case 4*b* are integrally formed by thermally welding uneven fitting parts formed on end surface portions. A suction port 4*c* is formed at a central part of the first fan case 4*a*. A cylindrical bearing holder 9 is locked by a sleeve 9*a* concentrically arranged on an outer side, which are integrally assembled through a damper 9*b* at a central opening part of the second fan case 4*b*. A pair of bearings 10 are assembled to the bearing holder 9. For example, a rolling bearing is used as the pair of bearings 10. A shaft 11 is fitted into the pair of bearings and supported so as to rotate. The pair of bearings 10 are assembled to the shaft 11 so as to be respectively positioned in the axial direction by a retaining washer. One end side of the shaft 11 enters the fan case 4, and the impeller 2 is integrally assembled to the one end side by press-fitting, adhesion or combination of them.

In the impeller 2, blades 2*b* are formed to stand on a disc-shaped main plate 2*a* at plural places from the central part toward an outer peripheral direction. A shroud 2*c* is formed so as to connect standing end portions of the respective blades 2*b*, which is formed facing a top surface concave portion 4*d* of the first fan case 4*a*. An outer peripheral end portion of the main plate 2*a* is extended to a position facing the blowing path 3. Moreover, a flow path guide 3*a* forming the blowing path 3 for compressed air fed into the blowing path 3 to be a circular shape in cross section is provided in the second fan case 4*b*.

The blowing path 3 is formed by combining a first curved portion 4*e* provided on an outer peripheral side of the first fan case 4*a* and a second curved portion 4*f* provided on an outer peripheral side of the second fan case 4*b*. Air sucked from the suction port 4*c* passes through the blowing path surrounded by the shroud 2*c* and the main plate 2*a* along the blades 2*b* of the impeller 2 while being accelerated toward an outer peripheral side of the main plate 2*a*, and fed into the blowing path 3 spreading downward from the main plate 2*a* in the axial direction.

In a lower part of the second curved portion 4*f* of the second fan case 4*b*, a first protruding wall portion 4*g* and a second protruding wall portion 4*h* are annularly provided to protrude with a prescribed interval on an inner side in the radial direction and on an outer side in the radial direction, and a concave groove 4*i* is formed between a pair of protruding wall portions 4*g*, 4*h*. As described later, a case opening end portion of the motor case 7 (a first motor case 7*a*) is inserted into the concave groove 4*i*, and the first protruding wall portion 4*g* is fitted to the motor case 7 so that an outer peripheral surface of the first protruding wall portion 4*g* overlaps with an inner peripheral surface of the motor case 7, thereby being positioned in the radial direction.

The motor case 7 includes the cylindrical first motor case 7*a* assembled to the fan case 4 (second fan case 4*b*) and a second motor case 7*b* blocking an opening end of the first motor case 7*a*.

A flange portion 7*c* is provided to protrude on an outer peripheral surface of the first motor case 7*a*. The fan case 4 is assembled to the motor case 7 by allowing the second protruding wall portion 4*h* of the second fan case 4*b* to abut on the flange portion 7*c* so that positioning between the fan case 4 and the motor case 7 in the axial direction is performed. The flange portion 7*c* is positioned with screw holes provided in the second protruding wall portion 4*h* and the fixing screws 8*a* are screw-fitted, thereby integrally assembling the fan case 4 to the motor case 7.

A flange portion 7*d* is provided to protrude on an outer peripheral surface of the second motor case 7*b*. Fixing screws 8*b* are screw-fitted in a state where an end surface of the first motor case 7*a* is allowed to abut on the flange portion 7*d* to position respective screw holes, thereby integrally assembling the first motor case 7*a* to the second motor case 7*b*. An annular motor protruding wall portion 7*e* is provided to protrude in the axial direction on an inner peripheral side of the flange portion 7*d* of the second motor case 7*b*. The motor protruding wall portion 7*e* is provided to protrude at a position facing the first protruding wall portion 4*g* of the fan case 4 in the axial direction.

The stator 5 is assembled to an inner wall surface 7*f* of the first motor case 7*a* through a sealing material 12. Specifically, a stator core 5*a* is assembled to the inner wall surface 7*f* of the first motor case 7*a* through the sealing material 12 covering an outer peripheral surface and both end edge portions of the stator core 5*a* in the axial direction. As the sealing material 12, an annularly-molded elastic member such as vibration isolation rubber or elastomer (for example, EPDM (ethylene propylene diene rubber) or the like) is used. Accordingly, vibration transmitted from the stator 5 and the rotor 6 to the motor case 7 and the fan case 4 can be absorbed by the sealing material 12 to thereby secure vibration isolation properties.

The stator core 5*a* is fixed to the inner wall surface 7*f* of the first motor case 7*a* through the sealing material 12 so that an annular core back portion 5*b* is fixed thereto. Pole teeth 5*c* are provided to protrude at plural places from the annular core back portion 5*b* to an inner side in the radial direction. The stator core 5*a* is covered with an insulator 5*d*, and coils 5*e* are wound around respective pole teeth 5*c* through the insulator 5*d*. The pole teeth 5*c* of the stator core 5*a* are arranged to face rotor magnets 6*b*. A motor substrate 13 is supported by the insulator 5*d*. Coil leads led out from respective coils 5*e* are connected to the motor substrate 13, and a hall IC 13*a* for detecting a magnetic pole position of the rotor and the like are mounted thereon. Moreover, a lead wire 14 for power supply is connected to the motor substrate 13. The lead wire 14 is lead out to the outside through a grommet 15 provided at an opening part of the second motor case 7*b* to be wired.

The other end side of the shaft 11 enters the motor case 7. The rotor 6 is assembled to the other end side of the shaft 11. Specifically, the rotor magnets 6*b* are concentrically mounted to the shaft 11 through a rotor yoke 6*a*. In the rotor magnets 6*b*, N-poles and S-poles are alternately magnetized in a circumferential direction. In the rotor 6, a position detection magnet 16 is assembled to the other end portion of the shaft 11 so as not to fall off in the axial direction. Magnetic poles of the position detection magnet 16 correspond to the rotor magnets 6*b*, and a rotor position is detected by the hall IC 13*a* arranged to face the magnet on the motor substrate 13.

As described above, when the fan case 4 is integrally assembled to the motor case 7, the first protruding wall portion 4*g* of the fan case 4 and the motor protruding wall portion 7*e* provided in the motor case 7 sandwich both end edge portions 12*a* of the sealing material 12 so as to press them, respectively. Specifically, as shown in an enlarged view of FIG. 1B, a tip-end pressing portion 4*g*1 of the first protruding wall portion 4*g* is formed in an R-surface (the motor protruding wall portion 7*e* is not shown as it has the same shape). Accordingly, when the first protruding wall portion 4*g* and the motor protruding wall portion 7*e* sandwich the facing axial-direction both end edge portions 12*a* of the sealing member 12, the sealing material 12 is deformed so that a wall thickness of the pressed sealing material 12 is reduced in the axial direction and positively swells to an inner side in the radial direction and an outer side in the radial direction as shown by right and left arrows.

Accordingly, vibration transmitted from the stator 5 and the rotor 6 to the motor case 7 and the fan case 4 can be absorbed by the sealing material 12 to secure vibration isolation properties. Moreover, the sealing material 12 pressed by the pair of protruding wall portions 4*g*, 7*e* which face each other in the axial direction is deformed to the inner side in the radial direction and the outer side in the radial direction, which increases adhesiveness between the outer peripheral surface of the stator core 5*a* (core back portion 5*b*) and the inner peripheral surface of the first motor case 7*a*; therefore, fluid leaking out from the inside of the motor case 7 can be sealed and airtightness can be increased. Furthermore, the sealing member 12 that increases airtightness and vibration isolation properties is arranged to be concentrated at the inner wall surface 7*f* of the first motor case 7*a*, which reduces the number of parts and assembly man-hours; therefore, mass production at low cost can be realized.

The case opening end portion of the first motor case 7*a* is inserted into the concave groove 4*i* between the first protruding wall portion 4*g* and the second protruding wall portion 4*h*, and the first protruding wall portion 4*g* overlaps with the inner peripheral surface 7*f* of the first motor case 7*a*, thereby being positioned in the radial direction.

The outer peripheral surface of the first protruding wall portion 4*g* is fitted to the inner peripheral surface of the first motor case 7*a* by being overlapped with each other as described above, thereby assembling the fan case 4 and the motor case 7 while being positioned in the radial direction and reducing a gap between the fan case 4 and the motor case 7 in the radial direction as much as possible; therefore, assemblability can be improved and airtightness can be also improved since the case opening end portion of the motor case 7 is inserted into the concave groove 4*i* and fitted in a labyrinth manner.

The second protruding wall portion 4*h* is assembled so as to be pushed onto the flange portion 7*c* provided to protrude on the outer wall of the first motor case 7*a* while being positioned in the axial direction; therefore, assemblability can be improved and airtightness can be also improved by reducing a gap in the axial direction of the fan case 4 and the motor case 7 as much as possible.

Furthermore, the sealing material 12 is deformed so that the wall thickness of the sealing material 12 in the axial direction positively escapes to the inner side in the radial direction and the outer side in the radial direction, which increases adhesiveness between the outer peripheral surface of the stator core 5*a* and the inner peripheral surface of the motor case 7 through the sealing material 12, and increases adhesiveness between an axial-direction end surface of the stator core 5*a* and the fan case 4 through the sealing material 12; therefore, it is possible to transmit generated heat of the stator 5 to the motor case 7 and the fan case 4 to thereby maintain heat dissipation properties.

Although the rolling bearing is cited as an example of the pair of bearings 10, the bearing is not limited to this, and other bearings, for example, a fluid dynamic bearing, a sliding bearing and so on may be adopted.

What is claimed is:

1. A blower in which a fan case housing an impeller and provided with a blowing path is integrally assembled to a motor case housing a motor that drives the impeller to rotate, and outside air is sucked into the fan case from an axial direction by rotation of the impeller and discharged from the blowing path provided on an outer side in a radial direction, wherein a stator core is assembled to an inner wall surface of the motor case through a sealing material covering an outer peripheral surface and both end edge portions in the axial direction of an annular core back portion, which is assembled so that both end edge portions of the sealing material in the axial direction are pressed respectively by annular protruding wall portions provided in the fan case and the motor case so as to face each other, a thickness of the sealing material is reduced in the axial direction, and the sealing material is deformed to the inner side in the radial direction and the outer side in the radial direction to increase adhesiveness between an outer peripheral surface of the core back portion and an inner peripheral surface of the motor case.

2. The blower according to claim 1, wherein the fan case and the motor case are assembled such that a first protruding wall portion and a second protruding wall portion are annularly provided to protrude with a prescribed interval on an inner side in the radial direction and the outer side in the radial direction, thereby forming a concave groove between a pair of protruding wall portions, and a case opening end portion of the motor case is inserted into the concave groove and the first protruding wall portion is fitted to the motor case so that an outer peripheral surface of the first protruding wall portion overlaps with an inner peripheral surface of the motor case, thereby being positioned in the radial direction.

3. The blower according to claim 2, wherein the fan case and the motor case are assembled such that the second protruding wall portion is assembled so as to be pushed onto a flange portion, which is provided to face the fan case and to protrude on an outer peripheral surface of the motor case while being positioned in the axial direction.

4. The blower according to claim 1, wherein pressing surfaces of the protruding wall portions respectively provided in the fan case and the motor case so as to face each other in the axial direction have a curved surface shape.

5. The blower according to claim 1, wherein an annular elastic member which is composed of vibration isolation rubber or elastomer is used as the sealing material.

* * * * *